United States Patent [19]

Menchetti

[11] Patent Number: 4,811,539

[45] Date of Patent: Mar. 14, 1989

[54] WALL FRAMING SYSTEM

[75] Inventor: Robert J. Menchetti, Buffalo, N.Y.

[73] Assignee: National Gypsum Company, Dallas, Tex.

[21] Appl. No.: 115,946

[22] Filed: Nov. 2, 1987

[51] Int. Cl.[4] ..... E04B 5/52

[52] U.S. Cl. ..... 52/486; 52/511

[58] Field of Search ..... 52/486, 487, 511

[56] References Cited

U.S. PATENT DOCUMENTS 3,948,011 4/1976 Price et al. ..... 52/511 X
4,128,979 12/1978 Price ..... 52/481
4,245,448 1/1981 Agar ..... 52/511 X
4,353,192 10/1982 Pearson et al. ..... 52/481 X

*Primary Examiner*—David A. Scherbel
*Assistant Examiner*—Creighton Smith
*Attorney, Agent, or Firm*—Laird F. Miller; Robert F. Hause

[57] ABSTRACT

A wall framing system including U-shaped metal studs in which there are two web portions with a plurality of aligned holes in the two webs, short sections of channel are disposed through said aligned holes for supporting wallboard thereon, and means are provided near the ends of the short channel for maintaining the ends of the channels in a fixed position relative to the wallboard supported thereon.

20 Claims, 3 Drawing Sheets

WALL FRAMING SYSTEM

BACKGROUND OF THE INVENTION

This invention relates to metal framing on which wallboard is mounted in the construction of walls and partitions, and, in particular, a double webbed metal stud in combination with a short wallboard supporting channel which is disposed through aligned knockouts in the stud's two webs.

U.S. Pat. No. 4,128,979 discloses a suspension assembly consisting of a plate with panel-piercing members and a suspension clip for attachment to the plate and for engaging over an upwardly extending side leg of an elongate channel member. The channel member is supported by a plurality of vertical metal studs. Each metal stud has a single web portion with a cut-out, and the channel member extends through the cut-out of at least two spaced-apart, parallel studs.

Sheet metal studs with only a single web portion are somewhat lacking in stiffness and stability. Channel members which extend throughout the full length of a wall are costly, creating a very substantial expense when considering all of the walls in any given building.

SUMMARY OF THE INVENTION

The present invention is directed to an improved combination of stud and channel for support of wallboards in walls and partitions. The stud is best described as having a U-shaped cross section, as compared to the prior C-shaped studs of U.S. Pat. No. 4,128,979, or I-shaped studs of U.S. Pat. No. 4,353,192. Of primary significance is the fact that the novel U-shaped studs have two spaced parallel web portions, each of which contains aligned knockouts.

The channel, of the present invention, is relatively short, having a cross section which fits through the two aligned knockouts in a relationship which prevents rotation of the channel around the lengthwise axis of the channel, and having a length sufficient to project out from the stud a distance, at least at one end, sufficient to receive and support a wallboard supporting clip, on one of the upwardly extending flanges of the channel. The channel also preferably includes spacer means on the ends for preventing movement of the channel ends toward or away from the adjacent wallboards.

It is an object of the invention to provide a more efficient wall framing system.

It is a further object to provide a novel combination of U-shaped stud and short wallboard supporting channels, mounted in knockouts in the dual webs of such studs.

It is a still further object to provide an improved wall framing system for use with panel piercing suspension assemblies having suspension clips for engaging over an upwardly extending side leg of a short piece of channel mounted in knockouts of a double web stud.

BRIEF DESCRIPTION OF THE DRAWINGS

These and other objects and advantages will be more readily apparent when considered in relation to the preferred embodiments, as set forth in the specification, and shown in the drawings, in which.

DESCRIPTION OF THE PREFERRED EMBODIMENTS

Figure 1:
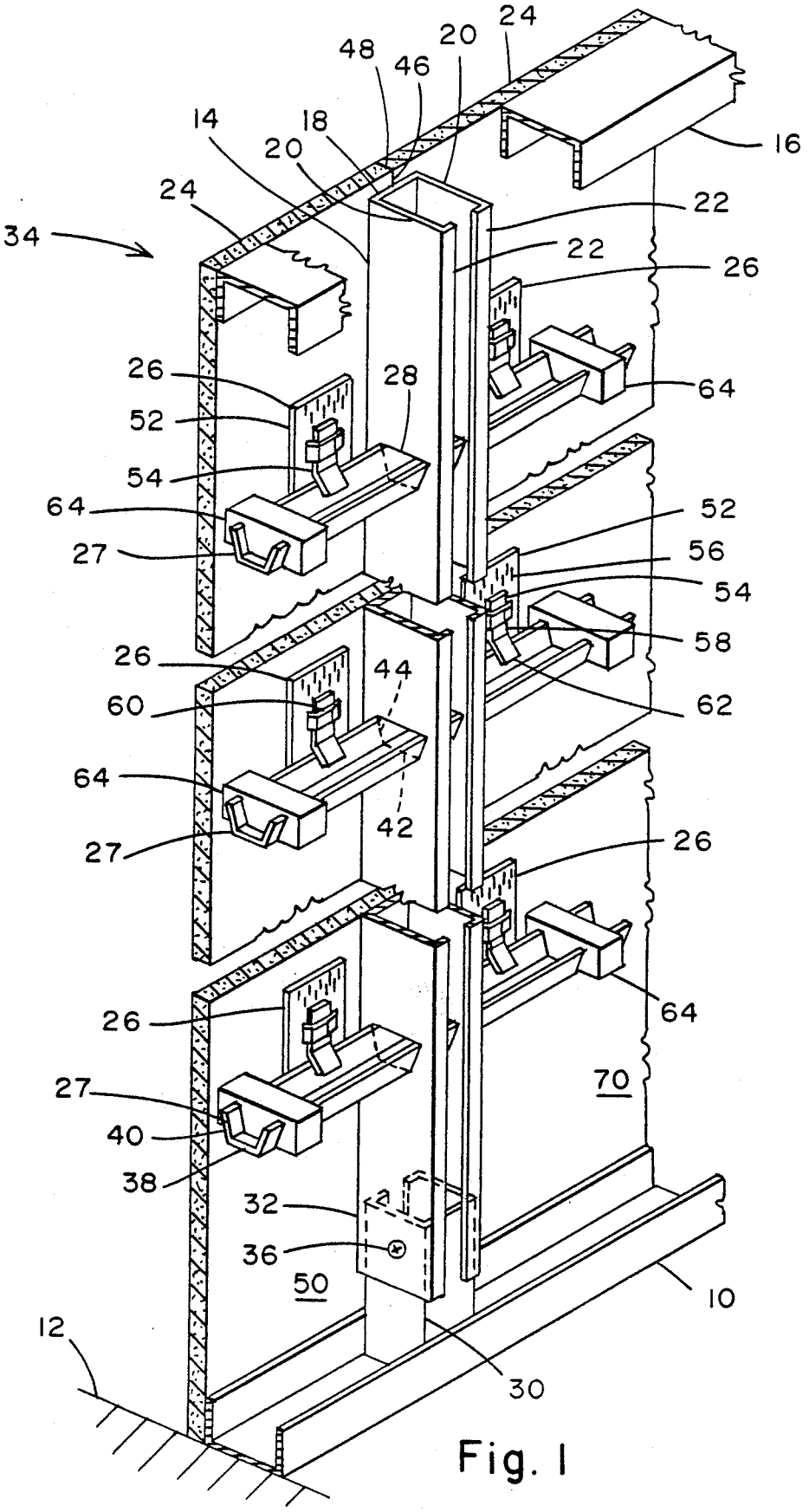
FIG. 1 is an isometric view of a partially constructed hollow partition having a framing system embodying the invention.

Referring to FIG. 1 there is shown an upwardly opening sheet metal floor track 10 affixed to a floor 12 by any suitable means, with a novel sheet metal U-stud 14 mounted in floor track 10 and extending upward into a standard downwardly opening ceiling track 16, shown with portions broken away.

U-stud 14 is an elongate, formed sheet metal stud having a solid face 18, two web portions 20, 20 and two inwardly directed flanges 22, 22 which in effect form the opposite face of the U-stud 14. The solid face 18 has two gypsum wallboards 24, 24 mounted against it, each of which wallboards 24, 24 are supported and held firmly against U-stud 14 by suspension assemblies 26, which are affixed to the wallboards 24, 24 and are supported on novel metal short channels 27 which are disposed extending through aligned openings 28, 28 in the two web portions 20, 20 of U-stud 14.

U-stud 14 includes, at the bottom, a slightly smaller telescoping section 30, otherwise similar in structure to the main section 32, which section 30 fits within main section 32 and is thus adjustable to provide the desired total length of U-stud 14. In constructing a wall 34 with U-studs 14, a U-stud 14 is adjusted to a desired length and then a small self-drilling, self-tapping screw 36 is inserted through overlapping parts of telescoping section 30 and main section 32, locking the two sections at the desired length.

Figure 2:
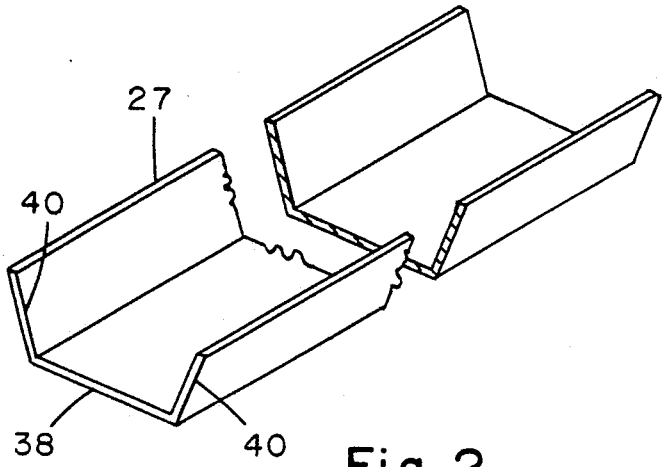
FIG. 2 is an isometric view of the short channel of FIG. 1.

U-stud 14 has knockouts or openings 28, 28 in each web portion 20, 20 which are shaped to receive a short channel 27 and hold it very firmly. The short channels 27 of FIG. 1 are shown in FIG. 2, being preferably about eight inches in length and including a horizontal bottom wall 38 and a pair of outwardly-angled upwardly-directed sidewalls 40, 40. Accordingly, in the embodiment of FIG. 1, the openings 28, 28 have a shape of an upside-down truncated cone with a bottom edge 42 equal in length to the width of channel bottom wall 38 and two side edges 44, 44 equal in length to the width of the channel sidewalls 40, 40. Each short channel 27 is placed originally into two aligned openings 28, 28 by inserting it endwise therethrough until an equal amount of channel 27 extends out on each side of U-stud 14.

Preferably, each wallboard 24, 24 is four feet wide and the U-studs 14 are disposed in spaced parallel positions two feet apart on center. Wallboards 24 are mounted with vertical edges 46 forming a wallboard joint 48. In the embodiment of FIG. 1 the wallboard joint 48 is located against the solid face 18 of U-stud 14.

U-stud 14 has three short channels 27 extending therethrough at spaced apart vertical locations. Each wallboard 24 has three suspension assemblies 26 affixed to each side edge portion 50, with vertical spacings equal to the spacings between the short channels 27. At each wallboard joint 48, there are thus six suspension assemblies 26, with three on each of the two adjacent wallboards 24, 24.

The suspension assemblies 26 comprise a gang nail plate 52 and a spring clip 54, all as completely described in U.S. Pat. No. 4,128,979, the disclosure of which is hereby included herein by reference. Briefly, the gang nail plate 52 is affixed to the wallboard 24 by a plurality of tangs (not shown) which were formed by bending small pointed sections of metal perpendicularly outward forming tang-shaped holes 56. The removable spring clip 54 is attached to the gang nail plate 52 by a rectilinear upper portion 58 which passes through a channel 60 in the vertical center of gang nail plate 52. The spring clip 54 also includes an outwardly inclined lower cam portion 62 which provides a camming action when the clip 54 engages a sidewall 40 of short channel 27, urging the wallboard 24 firmly against the U-stud 14.

Figure 3:
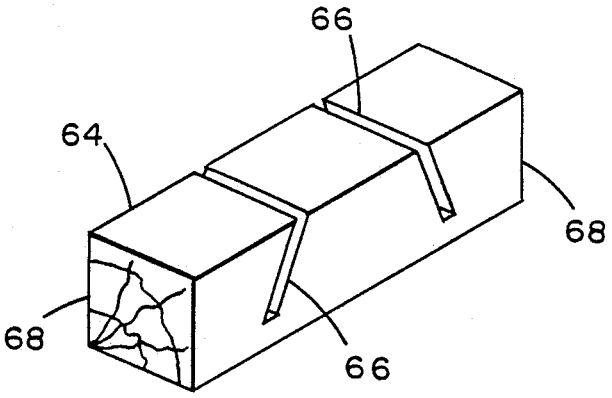
FIG. 3 is an isometric view of the spacer, shown on the end of the short channel in FIG. 1.

Also shown in FIG. 1 are channel stabilizing blocks 64, one block 64 on each end of each short channel 27. Blocks 64 are each formed of a width equal to the width of web portions 20, 20 of U-stud 14, and, as shown in FIG. 3, with a pair of upwardly angled slots 66, 66. Slots 66, 66 provide a means for affixing a block 64 on the end of a short channel 27 with end portions 68, 68 extending equally in each direction to abut against the back face 70 of each wallboard 24. Thus the blocks 64 keep the short channel 27 centered between the wallboards 24 of the two sides of the wall 34 or, in particular, the blocks 64 prevent the suspension assembly 26 from pulling the short channel 27 toward the wallboard back face 70.

Figure 6:
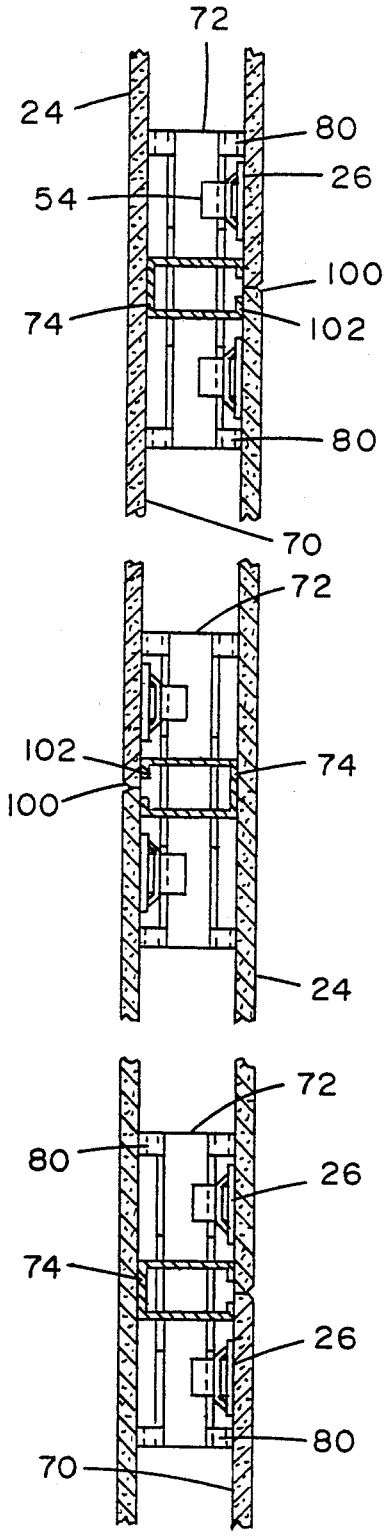
FIG. 6 is a sectional plan view of a hollow wall constructed with studs and short channels as in FIG. 5.
Figure 4:
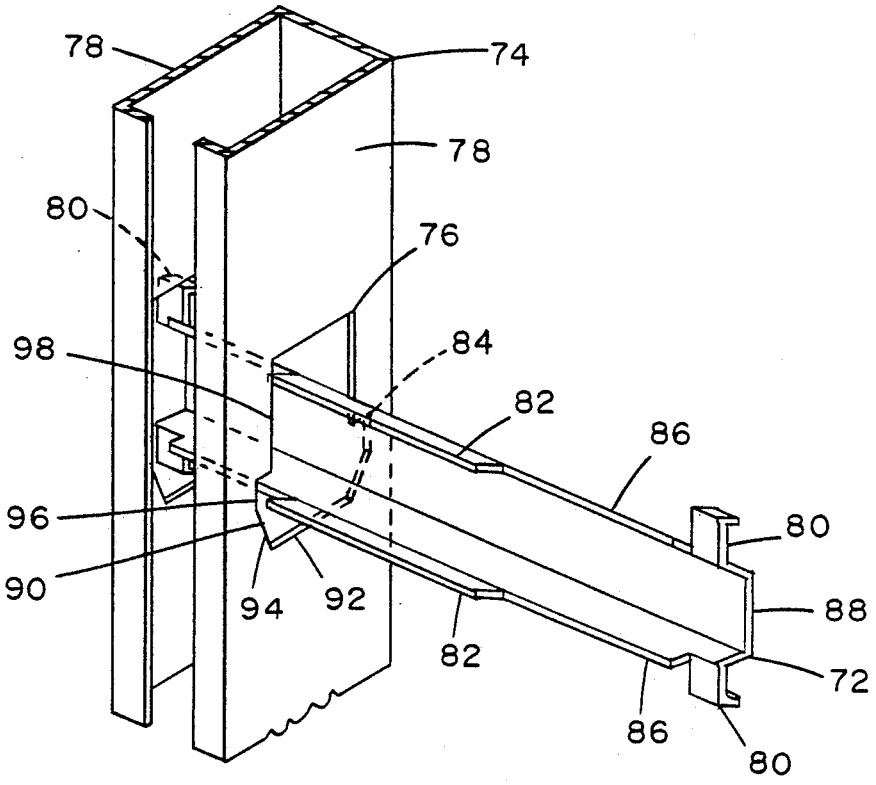
FIG. 4 is an isometric view of a modified form of stud and short channel as the channel is being inserted into the stud knockouts.
Figure 5:
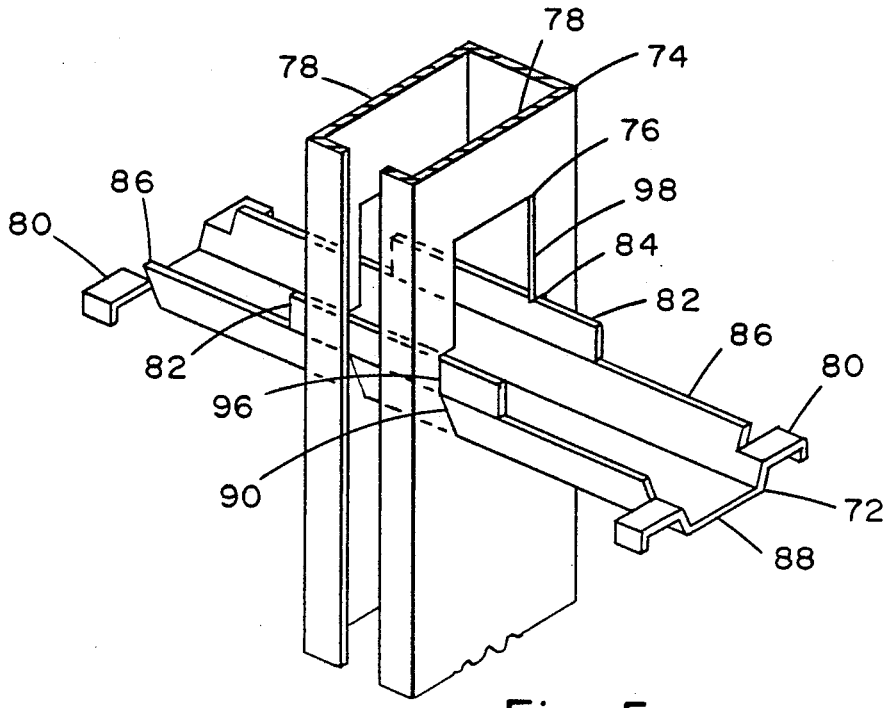
FIG. 5 is an isometric view of the stud and short channel of FIG. 4 in final position with a suspension assembly supported thereon.

FIGS. 4, 5 and 6 show a modified form of short channel 72. In FIG. 4, short channel 72 is shown being inserted into a modified U-stud 74, with knockouts or openings 76, 76 in each web portion 78, 78. In FIG. 5, the short channel 72 is shown fully inserted into the U-stud 74. In FIG. 6, a plurality of U-studs 74 are shown with wallboard 24 mounted by suspension assemblies 26 on the short channels 72.

The structure of short channel 72 is markedly different from short channel 27, in that stabilizing wings 80, 80 are formed on each end of the short channel 72, and extended vertical sidewalls 82, 82 are formed in a center portion of the short channel 72. The stabilizing wings 80, 80 consist of outwardly folded sections of the sheet metal of short channel 72, which extend outward in each direction to produce a total width equal to the width of the web portions 78, 78 of U-stud 72. The pair of stabilizing wings 80, 80 on each end of short channel 72 thus provide the function which is provided by stabilizing blocks 64 with short channel 27.

Extended vertical sidewalls 82, 82 are formed to fit firmly under overhanging wall portions 84, 84 of each web portion 78 and are an extension of the outwardly-angled, upwardly-directed sidewalls 86, 86, which with bottom wall 88, extend the full length, preferably about eight inches, of short channel 72. The extended vertical sidewalls 82, 82 are located only in about the middle one-third of the length of short channel 72.

The structure of openings 76, 76 in each web portion 78, 78 is markedly different from that of openings 28, 28, in that the openings 76, 76 have a total height sufficient for the stabilizing wings 80, 80 to pass therethrough when the channel is rotated 90° about its central axis and the stabilizing wings 80, 80 extend vertically from sidewalls 86, 86. Openings 76, 76 include a lower section 90 which has the shape of an upside-down truncated cone with a bottom edge 92 equal in length to the width of channel bottom wall 88, and two side edges 94, 94 equal in length to the width of the channel sidewalls 86, 86. Lower section 90 is thus similar to the openings 28, 28 of short channel 27.

Openings 76, 76 next include an extended wide portion 96 which is equal in width to the width of the widest part of the lower section 90 and is equal in height to the width of the extended vertical sidewalls 82, 82. Openings 76, 76 include a top portion 98 which provides a total height of openings 76, 76 equal to or greater than the width of short channel 72 at its widest, the stabilizing wings 80, 80. Top portion 98 is narrower than the extended wide portion 96, thus resulting in forming the overhanging wall portions 84, 84 of each web portion 78, under which the extended vertical sidewalls 82, 82 are firmly held.

Thus the short channels 72 are inserted about one-quarter of their length through the openings 76, 76 in U-stud 74, with the stabilizing wings 80, 80 extending vertically. The channels 72 are then rotated 90° so the stabilizing wings 80, 80 extend horizontally and the channels 72 are then inserted another one-quarter of their length through openings 76, 76 so that the extended vertical sidewalls 82, 82 are disposed under and firmly against overhanging wall portions 84, 84.

The short channels 72 are then in a firm condition to receive suspension assemblies 26 and support wallboards 24.

FIG. 6 shows a sectional plan view of a wall constructed with modified U-studs 74, three studs being shown, arranged in alternating directions. Short channels 72 are shown extending through each U-stud 74. Wallboards 24 are disposed against the two faces of the U-studs 74. The U-studs 74 are shown spaced apart 24 inches on center. The wallboards 24 are 48 inches wide, and have joints 100 between abutting wallboards. The joints 100 are shown located over the flanges 102 of U-studs 74. Thus immediately behind each joint 100 there is no metal, avoiding the prior problem of metal showing through some joints with prior C-shaped or I-shaped studs.

The U-studs 74 have short channels 72 extending horizontally therethrough, with equal portions on each side of the U-studs 74. The stabilizing wings 80, 80 on each end of each short channel 72 extend outwardly and contact the wallboard back face 70 of the adjacent wallboard 24.

Suspension assemblies 26 are affixed to the wallboard back face 70 near each joint 100, a distance from the joint 100 sufficient for the spring clip 54 to engage the sidewall 86 of a short channel, between the stabilizing wing 80 and the extended vertical sidewall 82.

The present invention makes possible the use of wall furniture hangers of the type which extend between wallboards, at a joint, with the furniture hangers extending into the open side of a U-stud 14 or 74 and hooking over a short channel 27 or 72. Alternatively a standard wall furniture slotted channel can be disposed within a U-stud 14 or 74 along the open side of the stud, for receiving supporting standard wall furniture hangers, which can extend between wallboards, at joints, to hook into the standard slotted channel.

Having completed a detailed disclosure of the preferred embodiments of my invention, so that others may practice the same, I contemplate that variations may be made without departing from the essence of the invention.

I claim:

1. A wall framing system comprising a plurality of vertical metal studs, a plurality of short channels, and means for mounting wallboard on said short channels, said studs each having at least two web portions in spaced apart relationship, said webs each having openings, said openings in said webs being aligned with openings in a spaced apart web portion, said aligned openings in each said stud being shaped to receive and firmly hold one of said short channels with said channel protruding from said stud a sufficient distance to receive and retain at least one of said wallboard mounting means but not a sufficient distance to reach an adjacent stud, whereby said channel stability is provided by the extending of said short channel through two spaced apart openings.

2. A wall framing system as defined in claim 1 wherein each said short channel has means located at a portion of the channel spaced away from said stud which restrict lateral movement of said channel.

3. A wall framing system as defined in claim 2 wherein said lateral movement restricting means is a separate element which is attached to a short channel.

4. A wall framing system as defined in claim 2 wherein said lateral movement restricting means is a preformed portion of said short channel.

5. A wall framing system as defined in claim 1 wherein said means for mounting wallboard is a suspension assembly comprising a gang nail plate and a spring clip, said gang nail plate being insertable into the back face of a wallboard and said spring clip being adapted for connection to said gang nail plate and for providing a camming action when the lower portion is placed within said short channel, said camming action being an action which would tend to urge wallboard tightly against a stud.

6. In combination, a U-stud and a short channel, said U-stud having a pair of spaced parallel web portions and an interconnecting face portion forming a U-shaped cross section, said spaced parallel web portions having openings aligned, those in one web with those in the parallel web, said openings being shaped to receive and firmly hold said short channel, said short channel being disposed extending through said aligned openings and being firmly held therein.

7. The combination of claim 6 wherein said short channel has a bottom wall and two upwardly extending sidewalls and said web portion openings are four-sided openings with a bottom edge and side edges conforming to the shape of said channel bottom wall and sidewalls.

8. The combination of claim 7 wherein said sidewalls are upwardly extending and angled outwardly.

9. The combination of claim 6 wherein said openings in said web portions have a height greater than their width and wherein said opening sides includes an overhanging portion, whereby said short channel can be rotated 90° during insertion and rotated back 90° after at least partial insertion and whereby said channel can be firmly held under said overhanging portion.

10. The combination of claim 6 wherein said short channels have means near each end for engaging a back face of wallboard when mounted on said combination, said back face engaging means providing lateral stability to said short channels.

11. The combination of claim 6, further comprising wallboard affixed to said short channels by means affixed to said wallboard and means hung on said short channel.

12. The combination of claim 11, further comprising means near each end of said short channels engaging said wallboard, providing lateral stability to said short channels.

13. A hollow wall comprising a wall framing system as defined in claim 1, and a plurality of gypsum wallboard affixed to at least one side of said wall framing system, said means for mounting wallboards comprising a plurality of suspension assemblies, said suspension assemblies consisting essentially of a gang nail plate affixed to said wallboards and a spring clip connecting said gang nail clip to said short channels.

14. A hollow wall as defined in claim 13 further comprising means located at a portion of said channels spaced away from said studs which restrict lateral movement of said channel.

15. A hollow wall as defined in claim 13 wherein said U-stud consists of a main section and a short telescoping section which provides means for adjusting the length of said stud.

16. A hollow wall as defined in claim 13 wherein wallboards are affixed to both sides of said wall framing system, said U-studs are arranged in alternating positions, with wallboard joints on one side of said wall being disposed over studs in one of said two positions and with wallboard joints on the opposite side of said wall being disposed over studs in the opposite of said two positions.

17. A hollow wall as defined in claim 16 wherein said wallboard joints are disposed over an open side of said U-stud whereby the stud is not visible through portions of the joint at which the wallboard is not tightly abutted.

18. The method of constructing hollow walls comprising the steps of placing a plurality of U-studs in vertical spaced positions, said U-studs having a plurality of aligned openings in a pair of web portions in each said U-stud, placing a short channel through a plurality of said aligned openings in each said U-stud, and affixing wallboards on at least one side of said wall by means affixed to said wallboards and to said short channels.

19. The method of claim 18 wherein said openings conform substantially to the shape of said short channel and wherein said short channel is inserted into said openings with the short channels having an open side directed upwardly.

20. The method of claim 18 wherein said short channels have relatively wide stabilizing wings near each end, and wherein said short channels are inserted into said openings with the short channels having an open side directed sidewards and after partial insertion through said openings said channels are rotated so the open side is directed upwardly.

* * * * *